United States Patent [19]

Lee

[11] 4,397,378

[45] Aug. 9, 1983

[54] LUGGAGE ZIPPER PROTECTOR

[76] Inventor: Robert M. Lee, c/o Hunting World, 16 E. 53rd St., New York, N.Y. 10022

[21] Appl. No.: 326,730

[22] Filed: Dec. 2, 1981

[51] Int. Cl.[3] ..... A45C 13/36

[52] U.S. Cl. ..... 190/52; 190/41 Z

[58] Field of Search ..... 190/41 Z, 52, 48, 18 R

[56] References Cited

U.S. PATENT DOCUMENTS

| | | | |
|---|---|---|---|
| 1,862,614 | 6/1932 | Turano | 190/41 Z UX |
| 1,976,698 | 10/1934 | Gihon | 190/41 Z |
| 2,436,369 | 2/1948 | Allen | 190/41 Z UX |
| 2,442,044 | 5/1948 | Howard | 150/3 |
| 3,292,748 | 12/1966 | Rifkin | 190/41 Z X |
| 4,098,376 | 7/1978 | Pelavin | 190/41 Z X |
| 4,163,484 | 8/1979 | Delaney | 190/18 R |

*Primary Examiner*—Donald F. Norton

*Attorney, Agent, or Firm*—Steven H. Bazerman

[57] ABSTRACT

A zipper protector for use with luggage having one or more openings starting in the bottom of the case at the portion of the case which is near the corner where the ends meet, and extending around the corner and upwardly along that end, across the top and down the other end of the luggage and around the corner at the other end of the luggage to terminate at the bottom of the case, said protector consisting of a releasably securable flap of soft or rigid material pivotally attached to the bottom of and positioned so as to protect the portions of the zipper in the lower corner of the case against damage by abrasion or impact.

8 Claims, 3 Drawing Figures

LUGGAGE ZIPPER PROTECTOR

BACKGROUND OF THE INVENTION

This invention relates to luggage and, more particularly, the invention relates to a zipper protector especially useful for luggage.

Travel by air is, nowadays, a predominant form of travel. Along with the growth of the airline travel industry, there has been a revolution in the luggage industry to devise luggage particularly suited for use by air travelers.

Among the many considerations in designing such luggage, the most obvious factor to be considered is weight. The luggage to be carried on an aircraft is from a practical standpoint limited by weight as well as by size. In response to this consideration, various light weight materials, both rigid and soft, have been devised for use in modern luggage.

Another consideration, perhaps more important to the passenger than to the airline, is that of durability. The ability of airline baggage handlers and handling equipment to mar and destroy luggage is legendary. Thus, luggage manufacturers have devised materials for making luggage which are not only light weight, but durable—possibly even nearly indestructible in "normal handling". As an offshoot of the consideration of durability, it has been found that in many respects soft, flexible luggage can withstand the rigors of baggage handling better than luggage made of rigid materials.

A plethora of luggage styles made of soft, semi-rigid and rigid materials such as canvas, nylon, vinyl, leather and combinations thereof are currently being marketed. One feature common to many types of these is the closure used to secure the luggage from opening. This closure is the common zipper which comes in a variety of materials, styles, sizes and grades.

The zipper may be made of plastic or metal and it may be of conventional construction or be of the coil type. The zippers are typically used to close and secure a large compartment. In such construction, each such large opening is secured by one or more zippers. Such an opening may start at the bottom of the case when it is in an upright position, at the portion of the case which is near the corner where the end meets the bottom; extend around the corner and upwardly along that end; across the top; and down the other end of the luggage and around the corner to the other end of the bottom to terminate in the bottom of the case near the other lower corner. By means of this construction, when the zipper is open the compartment may be opened fully to completely expose the contents of the bag.

It has been found that such luggage, although generally resistant to damage, does suffer damage to the zippers at the lower corners.

The damage may occur in one of two fashions. The first is through abrasion. If the luggage is dragged or is in frictional contact with other surfaces during transport or in high vibration environments, the zipper or its tapes can be damaged by the resulting abrasion. Further, if the zipper is of the coil type, the cord which links the coils and thereby acts as a spacer may be damaged by such action. Secondly, the lower corner and the zipper contained therein are the most likely areas to suffer impact damage caused by rough handling of baggage.

SUMMARY OF THE INVENTION

It is, therefore, a primary object of the present invention to provide zipper protectors positioned around the lower corners of the luggage to protect the zippers from the type of damage described.

It is another object of the present invention to provide a zipper protector which protects particularly vulnerable areas of zippers from damage resulting from rough handling, dragging and other frictional contact in transit arising from vibration.

It is still another object of the present invention to provide soft, semi-rigid and rigid luggage with protectors for the zippers in the vulnerable lower corners of the luggage.

Consistent with the foregoing objects, the instant invention, in its broadest aspect, is a flap which may be made of the same material as the luggage or of some other material. The flap may be either flexible or rigid. If rigid it must be hinged. Each such flap extends over one of the vulnerable lower corners of the case to protect the zipper against damage. It is secured against accidental displacement but must be removable or releasable to allow the case to fully open.

The flap is secured at its lower end to the body of the luggage, preferably by stitching or if made from a rigid material, by a hinge member. At the upper end, the flap is secured to the body of the luggage at either side of the zipper. The securing means is preferably a combination of two such means. The first might be by snap fasteners, the halves at the upper corner of the flap cooperating with mating snap fastener halves at the corresponding location in the body of the luggage. The second fastening means might be a strip of cooperating hooks and loops sold under the trademark Velcro. Thus, by the use of two independent securing means, the protective flap is securely fastened astride the vulnerable lower corner of the zipper.

THE PRIOR ART

U.S. Pat. No. 3,292,748, issued Dec. 20, 1966 to Rifkin, discloses a bag having a continuous zipper closure extending along both ends and the top. The zipper terminates, at each end thereof, on the end walls. It does not extend into the bottom wall. A continuous seal is provided along the entire length of the zipper closure by mating pieces of Velcro. At the end of the zipper where the slide comes to rest there are a pair of covering flaps which cover the zipper slide. One of the flaps lies against the zipper slide and the other flap overlaps the first flap, the two flaps being held together by Velcro. These flaps are for the purpose of protecting against fire. Obviously the seal does not protect the zipper in the vulnerable corner area since the zipper of Rifkin does not extend into this area. Nor is there any teaching of the need for such protective function.

U.S. Pat. No. 4,098,376, issued July 4, 1978 to Pelavin, discloses a garment bag having a longitudinal zipper closure and a pair of transverse zipper closures. A hinged flap covers the area which the three zipper closures meet. This patent is obviously not directed to the protection of the zipper in the lower corner area.

U.S. Pat. No. 1,976,698, issued Oct. 9, 1934 to Gihon, discloses a handbag with a continuous zipper closure terminating at one end in a circular opening which is provided to accommodate the handle of a tennis racket. When the opening is not needed, a flap is applied over the same with four snap fasteners. The opening does not extend past the ends of the bag into the bottom and the flap is not directed to the protection of a zipper in this vulnerable corner area.

U.S. Pat. No. 2,436,369, issued Feb. 24, 1948 to Allan, shows a mail bag cover having a continuous opening extending across the top and part way down the sides. A longitudinal flap closes over the zipper to protect against the weather. This patent obviously has nothing to do with the protection of a zipper against abrasion and impact injuries in the lower corners.

U.S. Pat. No. 1,862,614, issued June 14, 1932 to Turano, discloses a construction wherein a longitudinal covering strip is fixed at one end to the bag and at the other end to the zipper slide. Thus, when the zipper is closed, the strip is pulled taut and covers the zipper. This patent is unrelated to the protection of luggage zippers in the lower corner region.

Finally, U.S. Pat. No. 2,442,044, issued May 25, 1948 to Howard, discloses a complicated construction for a laundry bag which includes a tongue-shaped element which lies over a zipper and, in turn, is held in place by another zipper element. The problem of lower corner abrasion and impact, and certainly not its cure, is not treated in this patent.

BRIEF DESCRIPTION OF THE DRAWING

The objects set forth above will be described, and other objects will become apparent, from a consideration of the following description taken with the annexed drawings wherein.

DETAILED DESCRIPTION OF THE PREFERRED EMBODIMENTS

Figure 1:
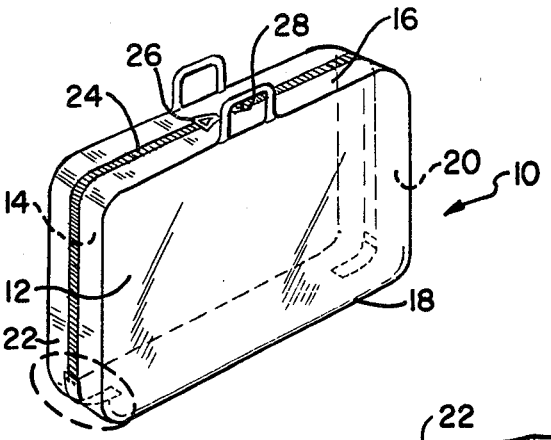
(PRIOR ART) FIG. 1
FIG. 1 is a perspective view of a typical prior art travelling bag construction with a single opening.

Referring first to FIG. 1, a typical travelling bag generally designated by the numeral 10 comprises front and rear walls 12 and 14, respectively, top and bottom walls 16 and 18, respectively, and end walls 20 and 22 respectively. Typically, a continuous opening starts in the bottom wall 18 at its opposite ends and extends along end walls 20 and 22 and top wall 16. Thus, when the bag is opened, it lies flat, since bottom wall 18 is either hinged longitudinally or the bag is so flexible that a longitudinal fold line appears along the longitudinal axis.

The continuous opening is provided with one or more zipper closures 24 extending beyond the lower ends of the end walls 20 and 22 and into the bottom wall 18 of the bag 10. If a single zipper is used, the zipper 24 could be equipped with a single slider which would travel from one end of the zipper to the other or, as illustrated in FIG. 1, a pair of sliders 26 and 28 may be used with a single continuous zipper, which sliders move to opposite ends of the zipper to open the bag which can either be moved to a location centrally of the top wall as shown in FIG. 1 or can be made to meet anywhere along the length of the zipper. The normal method of securing the opening in the closed position is to lock the zipper sliders together by means of a small padlock.

The area most vulnerable to damage is the bottom corner area outlined in phantom in FIG. 1 and its counterpart area at the opposing side of the luggage. As previously noted, such damage can be caused by abrasion when the bag is dragged or otherwise in vibratory contact with another surface, or by impact injury through rough handling. It is for the purpose of protecting these vulnerable areas from damage that the present invention was developed.

Figure 2:
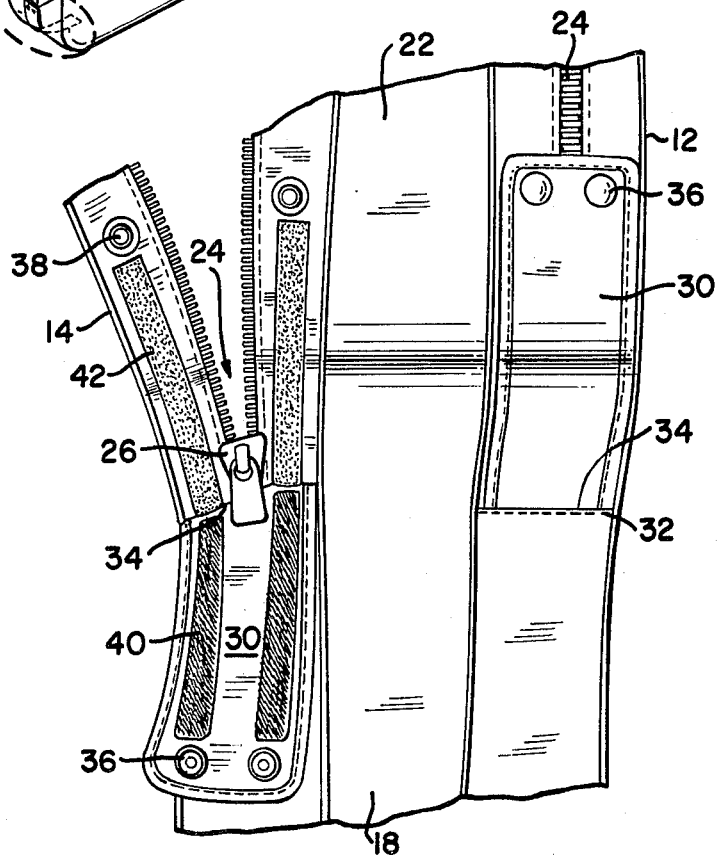
FIG. 2 is a fragmentary perspective view, on enlarged scale, of the lower corner of a travelling bag having two openings and embodying the instant invention.
Figure 3:
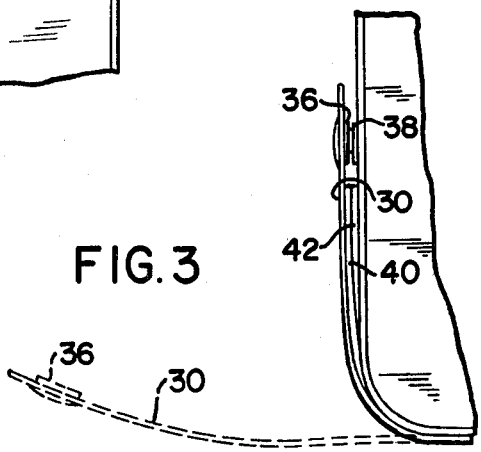
FIG. 3 is a partial front elevation view of said lower corner.

Attention is now directed to FIG. 2, which shows a case having a pair of openings in a spaced apart, parallel relationship, with each of the openings provided with one or more zippers 24. According to the present invention, a covering flap 30 is provided in the lower corner where an end wall meets the bottom wall. Flap 30 is fixed at its lower end to the bottom wall 18 of the case. The flap 30 is fixed by any suitable means, the preferred such means being stitching 32. Thus, a hinge line 34 is formed at the lower end of flap 30. At the upper end of flap 30 are a pair of snap fastener elements 36. Snap fastener elements 36 are disposed in the upper corners of flap 30 and cooperate with mating snap fastener elements 38, which are fixed to end wall 20 and 22 at either side of zipper 24. Extending downwardly from snap fastener elements 36 and 38 are hook and loop fabric tapes 40 and 42, which are sold under the trademark Velcro. Each of tapes 40 and 42 extends from the corresponding snap fastener element 36 and 30 essentially to hinge line 34. Thus, after the zipper 24 is closed, flap 30 is applied over zipper 24 whereby Velcro elements 40 and 42 mutually engage and snap fastener elements 36 and 38 engage. Flap 30 thereby protects and cushions the vulnerable lower corner area of the zipper from damage.

Alternative methods may be used to secure the flap 30 to the luggage. Equally, instead of a soft flap, a rigid protector or flap, properly shaped and hinged at its lower edge, may be used, especially in connection with rigid or semi-rigid cases. While the invention has been illustrated with a piece of luggage having soft sides, it may equally well be used with rigid and semi-rigid construction.

Accordingly, it will be appreciated that the objects set forth at the outset of this specification have been successfully achieved and that the invention may be otherwise variously embodied or practiced within the scope of the invention, which is defined only by the following claims.

What is claimed is:

1. In luggage of the type having a front wall, an opposed rear wall, a pair of opposed end walls, a top wall, and a bottom wall, the top and end walls being divided by a continuous opening starting in and extending between opposite ends of the bottom wall to allow said bag to open substantially flat, and at least one zipper closure being affixed to the continuous edges of said opening and extending into opposite end portions of said bottom wall, the improvement comprising an elongated flap hingedly fixed at one end to each said end portion of said bottom wall and extending upwardly over the corresponding end portion of the adjacent end wall and releasably secured to said end wall, whereby said flap protects and cushions said zipper at the corner portion where said end wall and said bottom wall meet.

2. The improvement of claim 1, wherein said flap is hingedly fixed at said one end by stitching.

3. The improvement of claim 1 or 2, wherein said flap is releasably secured to said end wall by a pair of fastening means disposed at either side of said zipper.

4. The improvement of claim 3, wherein each said fastening means comprises a snap fastener member in the upper corner of said flap mating with a cooperating snap fastener member on said end wall, and cooperating hook and loop fabric strips disposed between said snap fastener members and the hingedly fixed end of said flap.

5. The improvement of claim 4, wherein said bag comprises a plurality of said openings in spaced apart, parallel relationship, whereby said bag is subdivided into at least two compartments.

6. The improvement of claim 5, wherein said bag comprises two of said openings in spaced apart, parallel relationship, whereby said bag is subdivided into two compartments.

7. The improvement of claim 1, wherein the said flap is made of a rigid material which is hinged at one of its edges.

8. The improvement of claim 1, wherein said flap is hingedly fixed at said one end by riveting.

* * * * *